US006564808B1

(12) United States Patent
Hempfling et al.

(10) Patent No.: US 6,564,808 B1
(45) Date of Patent: May 20, 2003

(54) METHOD FOR REDUCTION OF TOBACCO SPECIFIC NITROSAMINES

(75) Inventors: Walter P. Hempfling, Mechancisville, VA (US); Gordon H. Bokelman, Chesterfield, VA (US); Newton E. Kalengamaliro, Winnipeg (CA); Dick L. Hilliard, Glen Allen, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/635,775

(22) Filed: Aug. 11, 2000

(51) Int. Cl.[7] ..... A24B 15/24

(52) U.S. Cl. ..... 131/297; 131/299; 131/300; 131/302; 131/309

(58) Field of Search ..... 131/297, 299, 131/300, 302, 309

(56) References Cited

U.S. PATENT DOCUMENTS

| | | | | |
|---|---|---|---|---|
| 771,355 | A | * | 10/1904 | Daniels, Jr. |
| 787,611 | A | * | 4/1905 | Daniels, Jr. |
| 1,757,477 | A | * | 5/1930 | Rosenhoch |
| 2,080,179 | A | * | 5/1937 | Merriam et al. |
| 4,343,317 | A | | 8/1982 | Bokelman |
| 4,362,170 | A | | 12/1982 | Keritsis et al. |
| 5,527,517 | A | | 6/1996 | Bridges et al. |
| 5,974,810 | A | | 11/1999 | Speronello |
| 6,294,108 | B1 | * | 9/2001 | Speronello et al. |

OTHER PUBLICATIONS

G.D. Simpson et al. "*A Focus on Chlorine Dioxide: The 'Ideal' Biocide*", Paper No. 472, The NACE Annual Conference and Corrosion Show.

*The Handbook of Chlorination and Alternative Disinfectants 3rd* ED., Van Nostrand Reinhold, New York, pp. 983–985.

David K. Jeng et al., "*Chlorine Dioxide, Gas Sterilization of Oxygenators in an Industrial Scale Sterilizer: A Successful Model*", Articicial Organs 14(5):361–368, Raven Press Ltd., New York (1990).

Ralph S. Tanner, "*Comparative Testing and Evaluation of Hard–Surface Disinfectants*", Journal of Industrial Microbiology, 4(1989) 145–154.

Jennifer L. Caulfield et al. "*Bicarbonate Inhibits N–Nitrosation in Oxygenated Nitric Oxide Solutions*" The Journal of Biological Chemistry, vol. 271, No. 42, (1996) pps. 25859–25863.

Written Opinion for PCT/US01/41652 dated Jun. 26, 2002.

Transmittal of International Preliminary Examination Report dated Nov. 6, 2002 for PCT/US01/41652.

Notification of Transmittal of the International Search Report or the Declaration for PCT/US01/41652, International Filing Date Aug. 10, 2001 dated Dec. 5, 2001.

* cited by examiner

*Primary Examiner*—Michael Colaianni
(74) *Attorney, Agent, or Firm*—Burns, Doane, Swecker & Mathis, LLP

(57) ABSTRACT

Tobacco is treated with an effective amount of one or more bactericidal gases before or during curing to reduce or eliminate bacteria, bacterial activity and/or fungal activity from tobacco leaves, and/or to reduce or eliminate the amount of tobacco-specific nitrosamine or bacterial endotoxin in cured tobacco leaves. Cured tobacco is treated with an effective amount of one or more bactericidal gases before or during storage to reduce or eliminate bacteria, bacterial activity and/or fungal activity from the cured tobacco.

4 Claims, 2 Drawing Sheets

METHOD FOR REDUCTION OF TOBACCO SPECIFIC NITROSAMINES

The invention relates generally to tobacco curing and more particularly to a method of treating and curing tobacco leaves so as to have low levels of or no detectable tobacco-specific nitrosamines and a reduced level of bacterial endotoxins as compared to untreated, cured tobacco leaves, and to treatment of cured tobacco so as to have low levels of or no bacterial activity, fungal activity or bacteria on cured tobacco during or after storage.

BACKGROUND OF THE INVENTION

It has been reported that air-cured and flue-cured tobacco contain tobacco-specific nitrosamines (TSNAs). See, "Effect of Air-Curing on the Chemical Composition of Tobacco", Anna Wiernik et al., Recent Adv. Tob. Sci, (1995), 21, pp. 39–80. According to Wiernik et al., TSNAs are not present in significant quantities in growing tobacco plants or fresh cut tobacco (green tobacco), but are formed during the curing process. Bacterial populations which reside on the tobacco leaves are stated to largely cause the formation of nitrites from nitrate during curing and possibly effect the direct catalysis of the nitrosation of secondary amines at physiological pH values. The affected secondary amines include tobacco alkaloids, which form TSNAs when nitrosated.

Various treatments of tobacco plants or harvested tobacco leaves have been suggested to reduce TSNA formation, including microwaving of flue-cured tobacco leaves (WO 98/58555).

Because curing of tobacco leaves is normally performed by the farmer who grows the tobacco, a simple, economical and non-labor-intensive method of reducing the bacterial population and/or activity, TSNA levels and bacterial endotoxin levels of the cured tobacco leaves is desirable.

SUMMARY OF THE INVENTION

The invention provides a treatment for tobacco leaves prior to or during curing which results in reduced or eliminated amounts of tobacco-specific nitrosamines, bacteria, bacterial activity and bacterial endotoxins in the cured tobacco leaves as compared to untreated cured leaves, and a treatment for cured tobacco leaves resulting in reduced or eliminated amounts of bacteria, bacterial activity, and/or fungal growth on stored cured tobacco leaves. The treatments include the use of effective amounts of one or more bactericidal gases, alone or in combination with one or more bactericidal treatments, such as wash solutions, visible or ultraviolet radiation, and sonic oscillation on the tobacco leaves.

In a first preferred embodiment, a tobacco leaf is treated with one or more bactericidal gases before or during curing, wherein upon completion of the curing process the treated tobacco leaf has a reduced or eliminated amount of tobacco-specific nitrosamines, bacterial endotoxins, bacteria, bacterial activity and/or fungal activity compared to non-treated cured tobacco.

In another embodiment, a tobacco leaf is treated with a combination of one or more bactericidal gases and at least one other bactericidal treatment before or during curing, wherein the other bactericidal treatment is selected from a wash solution, visible or ultraviolet light, sonic oscillation or a combination thereof, and wherein the treated tobacco leaf has one or more of a reduced or eliminated amount of tobacco-specific nitrosamines, bacteria, bacterial activity, fungal activity or bacterial endotoxins compared to non-treated cured tobacco.

In another embodiment, a cured tobacco leaf is treated with one or more bactericidal gases after curing and before and/or during storage, wherein upon completion of storage, the treated cured tobacco leaf has a reduced or eliminated amount of bacteria, bacterial activity and/or fungal activity as compared to non-treated stored cured tobacco.

In another embodiment, a cured tobacco leaf is treated with a combination of one or more bactericidal gases and at least one other bactericidal treatment after curing and before or during storage, wherein the other bactericidal treatment is selected from a wash solution, visible or ultraviolet light, sonic oscillation or a combination thereof, and wherein the treated cured tobacco leaf has one or more of a reduced or eliminated amount of bacteria, bacterial activity and/or fungal activity compared to non-treated stored cured tobacco.

In another embodiment, a method of reducing or eliminating tobacco-specific nitrosamines, bacterial populations, bacterial activity, fungal activity and/or bacterial endotoxins from uncured or cured tobacco leaf is presented. The method includes treating the uncured or cured tobacco leaf with an effective amount of one or more bactericidal gases, and optionally one or more of a wash solution, an effective amount of visible or ultraviolet light or an effective amount of sonic oscillation.

DETAILED DESCRIPTION OF THE INVENTION

Figure 1:
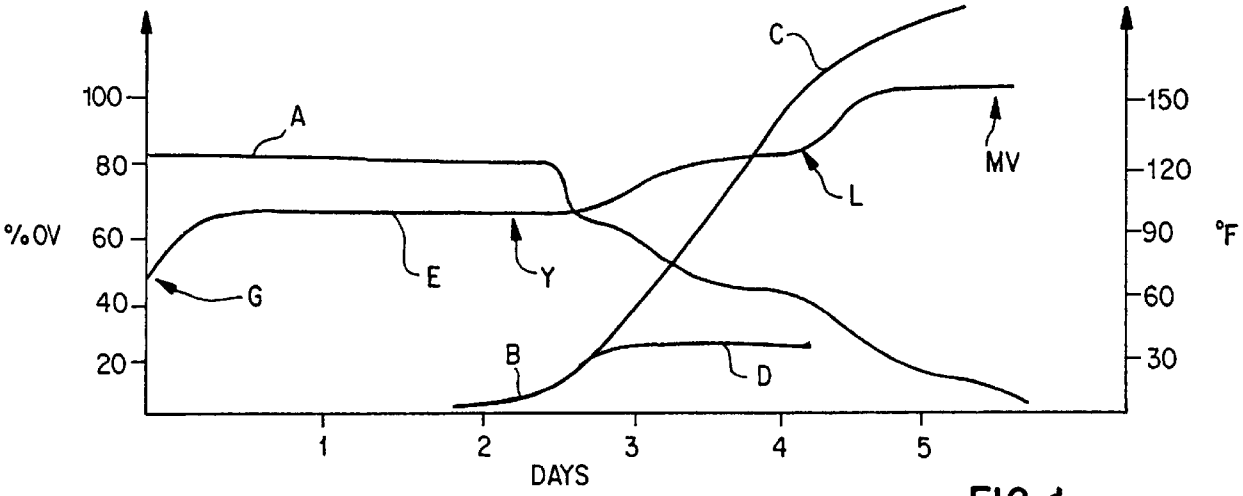
FIG. 1 Prior Art
FIG. 1 is a graphical representation of typical moisture, temperature and TSNA content in tobacco during a traditional flue-curing process of the prior art heating with a direct flame and heating with use of a heat exchanger.

The invention provides a process for reducing or eliminating tobacco-specific nitrosamines, or TSNAs, generated during the curing of tobacco leaves, whether such TSNAs are generated by chemical breakdown of the tobacco leaf during the curing process or by the action of bacteria during the curing process. The invention further reduces or eliminates bacterial populations, bacterial activity and/or fungal activity from tobacco leaves, and reduces or eliminates the amount of bacterial endotoxins in cured tobacco leaves when administered before or during curing of the tobacco leaves. The invention further reduces or eliminates bacterial populations, bacterial activity and/or fungal activity when administered before or during storage of cured tobacco.

Tobacco leaf or leaves, or uncured tobacco leaf or leaves, as used herein, is meant to include flue-cured and air-cured tobacco leaves which are green or partially cured. Thus, tobacco leaf or leaves may indicate the individual primed leaves of flue-cured tobacco (bright or Virginia tobacco), or the stalk-cut leaves as attached to the stalk of the burley or Maryland (air-cured) tobacco plant or as individual leaves which have been primed from the stalk of burley or Maryland tobacco (air-cured) tobacco.

Cured tobacco indicates both flue-cured and air-cured tobacco leaves which have completed the curing process.

Harvesting tobacco is meant to include both priming and stalk-cutting of tobacco.

Priming is meant to include removal of a tobacco leaf from a growing or harvested tobacco plant.

Bacterial endotoxin, as used herein, is meant to include both bacterial endotoxins generated by bacterial activity, and materials which create a false positive for bacterial endotoxins in the Limulus Amoebocyte Lysate (LAL) assay, such as β-glucans generated by fungal activity.

Bacterial populations on tobacco leaves are known to grow exponentially (after a "lag") during curing as observed in traditional curing practices. Bacteria gain entrance into the tobacco leaf in large numbers through stomata or cracks formed in the leaf cuticle by tissue necrosis, particularly during lamina and stem drying of the tobacco. Bacteria also gain entrance into the tobacco leaf at any time through a damaged leaf cuticle. Damage to the leaf cuticle may occur in the field, during harvesting, during leaf transport or during curing.

The bacterial population of tobacco leaves, both primed and stalk-cut, when harvested is about $10^5$ to $10^6$ bacteria/gram of dry weight of tobacco leaf. The heat of the yellowing process during flue-curing and the prolonged exposure time of air-curing both result in growth of the bacterial population during yellowing. Bacterial populations may increase by 10 to 20 fold during this period. Many of these bacteria are capable of reducing nitrates to nitrites. The nitrites may then accumulate in the tobacco leaf cells. Many of these bacteria are also capable of catalyzing the nitrosation from nitrite of secondary amines.

Bacteria on tobacco leaves may result in the presence of bacterial endotoxins. The bacterial populations found on green and curing tobacco leaves are primarily gram negative bacteria, including pseudomonads and enterobacters. These bacteria form lipopolysaccharides, or bacterial endotoxins, which can remain as a residue on the tobacco leaf even after the bacteria have been removed or destroyed.

Fungi also may be present on tobacco plants when harvested. Various fungi produce β-glucans, which can result in a false positive test for bacterial endotoxins, as quantified by the Limulus Amoebocyte Lysate (LAL) assay. Also, some fungi produce nitrite from nitrate. Therefore, the removal or reduction of fungal growth from tobacco leaves is also desired.

The inventors herein have devised novel and cost effective methods of reducing both the numbers and activity of bacterial and fungal populations and, therefore, TSNAs and bacterial endotoxins formed during the curing process. A preferred embodiment of the invention comprises treating tobacco leaves prior to or during flue curing or air curing by exposure to one or more bactericidal gases.

Bacterial and fungal growth on cured tobacco leaves during storage can occur due to infection of leaves in storage by bacteria or fungal spores. This may occur particularly if the cured tobacco is stored with a high moisture content, or if the cured tobacco is subjected to high humidity or heat during storage. Bacteria and/or fungal spores can contaminate the cured tobacco during handling, transport or storage. Alternately, it is possible that not all bacterial or fungal growth is eliminated during curing, and the remaining bacteria or fungi can propagate during storage, particularly under hot and/or humid conditions. Thus, means of treating stored cured tobacco to reduce or eliminate bacterial or fungal activity is desirable.

Therefore, the inventors herein have also devised a novel and cost effective method for reducing or eliminating bacterial and/or fungal activity or cured tobacco, such as result during storage of the tobacco, by treating the cured tobacco before and/or during storage with one or more bactericidal gases.

Bactericidal Treatment

In accordance with a preferred embodiment of the invention, one or more bactericidal gases can be applied to green (e.g., growing or harvested) tobacco plants or leaves, partially cured tobacco, or cured tobacco, and preferably is capable of killing or disrupting the biological activity of the bacteria and/or fungi present on the tobacco leaves. It is desirable that the bactericidal gas have minimal chemical reactivity with the tobacco leaf itself. The gas should have one or more of a bactericidal or bacteriostatic activity, but will be referred to herein as "bactericidal gas" for simplicity.

Suitable gases for use in the invention are disinfectants. Disinfecting gases which may be used include, but are not limited to, chlorine dioxide, sulfur dioxide, ethylene oxide, ozone, propylene oxide and the like. Other suitable bactericidal gases are known to practitioners in the art. Preferably, chlorine dioxide is used. The gases, such as ozone, can be dissolved in a solvent such as water or a surfactant for treating the tobacco, or can be used as a gas.

1. Uncured Tobacco Leaves

Uncured tobacco leaves are preferably treated one or more times with one or more bactericidal gases before completion of lamina drying or onset of necrosis in the leaves. In particular, treatment by one or more bactericidal gases, or bactericidal gas dissolved in a solvent such as water or a surfactant, can be performed on green leaves, during yellowing, at the conclusion of yellowing, and during lamina drying, for example.

It is preferable to treat the tobacco leaves before or during yellowing to remove bacterial populations before they can significantly increase in number and before they can do a significant amount of damage to the tobacco leaves. In particular, it is most preferable to treat green tobacco leaves, i.e., leaves which have not yet begun the curing process. Leaves undergoing yellowing may also be treated with good results.

Treatment of the tobacco leaves may occur more than once during the curing process. Preferably, green tobacco leaves are treated by exposure to one or more bactericidal gases or solvent containing one or more bactericidal gases before curing begins. The tobacco leaves can be additionally treated at least once during yellowing or after yellowing, as needed.

Practitioners in the art will recognize that the number, concentration and length of bactericidal gas treatments can be adjusted to take into account numerous factors, such as the type of leaf and, therefore, the curing process being used (flue-cured or air-cured), the temperature and humidity conditions during curing, the length of time the leaves require to complete each step of curing, the appearance of the leaves themselves and the amount of bacteria or fungal growth present, for example. Treatments comprise an effective amount of bactericidal gas, wherein an effective amount is the amount of gas over a specified exposure time, alone or in combination with other treatments described herein, sufficient to significantly reduce or eliminate bacterial populations, bacterial activity and/or fungal growth from the tobacco leaves, and to reduce or eliminate the amount of tobacco specific nitrosamines and bacterial endotoxins present in the cured tobacco as compared to untreated tobacco.

Treatment can be effected in any manner known to practitioners in the art. For example, machines may be used to generate the bactericidal gas on site as needed, or the bactericidal gas can be pumped into the curing barn or structure from storage tanks as needed. The gas can also be generated on site from a dry bactericidal precursor which reacts with aqueous liquid to form the bactericidal gas.

Treatment with bactericidal gas can be adjusted so that release of the gas is triggered by a rise in humidity or temperature beyond a certain level during curing. In this manner, the administration of the bactericidal gas is automatic, and can coincide with the appearance of conditions favorable to bacterial and fungal growth, such as increased humidity and/or heat.

For example, one or more sachets or packets of dry bactericidal precursor may be placed in the curing barn. An increase in humidity or spraying the tobacco with water or other aqueous liquids will cause a reaction between the aqueous liquid or water vapor and the dry bactericidal precursor, forming the bactericidal gas. For example, a sachet may contain $NaClO_3$ which will react with water or water vapor to form a bactericidal gas of $ClO_2$, which is released into the curing barn upon formation. Circulation of the gas in the curing barn may be aided by the use of one or more fans.

Sachets or packets of bactericidal agent can be placed in the curing barn before introducing freshly harvested tobacco leaves to the curing barn, or at any time during curing. Preferably, the dry bactericidal precursor is present in the curing barn before the tobacco leaves are introduced, before yellowing, during yellowing, or any combination thereof. The dry bactericidal precursor can also be present after yellowing but before drying of the tobacco leaves. Preferably the packets or sachets are removed before drying of the tobacco, especially heated drying as used in flue-curing.

The amount of bactericidal gas released in the curing barn may be monitored by any means known in the art. The gas level can be adjusted as needed by adding more bactericidal gas from storage tanks, generating additional bactericidal gas by machine, or by adding more dry bactericidal precursor to the curing barn, or by removing gas through forced ventilation or removal of the bactericidal gas generating means.

Alternatively, if the bactericidal gas is dissolved or entrained in a solvent, a rise in temperature or humidity in the curing barn can trigger a sensor to initiate spraying of the tobacco leaves with the gas containing solvent. Again, the concentration of bactericidal gas in the curing barn can be measured, and the amount of bactericidal gas containing solvent adjusted to treat the tobacco leaves with an effective amount of bactericidal gas.

The tobacco leaves preferably are treated in an enclosed area, most preferably an area tightly sealed in order to keep the bactericidal gas from dissipating before all tobacco leaves have been in contact with the bactericidal gas for the desired treatment period. The tobacco leaves may be treated with bactericidal gas or a solvent containing the bactericidal gas in a sealable barn or room which is used for curing. Alternately, small batches of tobacco leaves may be moved to a sealable room, chamber or vessel and treated with the bactericidal gas or solvent containing the same, then returned to the barn to resume curing. If the tobacco leaves are moved for treatment, the number of treatments should be kept to a minimum in order to avoid excessive breakage and loss of tobacco due to handling.

Preferable bactericidal gases for use in the invention are heavier than air. Therefore, if such a bactericidal gas is introduced into an enclosure at or near the top, the bactericidal gas will settle, dropping to the bottom of the enclosure, coating everything in the enclosure from the point of gas entry downward. This enables the efficient use of the bactericidal gas in large enclosures, such as curing barns, as well as in small enclosures, such as rooms or vessels.

Circulation of the bactericidal gas to ensure contact with all leaf surfaces may be aided by the use of one or more fans, especially recirculation fans. Other means of circulating air flow as are known to practitioners in the art can also be used to ensure contact of the bactericidal gas with the surfaces of all tobacco leaves in the barn.

Preferably, the treated tobacco is aired after treatment and before drying to remove residual gas from the area in which the tobacco is kept. For example, when tobacco is treated in a barn, the barn may be ventilated by natural dissipation or forced ventilation after the desired treatment period with fans or by any other means known to practitioners in the art. Preferably, the means of administering gas such as a sachet or packet of dry bactericidal precursor or a gas generating machine are removed once treatment of the tobacco leaves with the bactericidal gas is completed.

Flue-Cured Tobacco

Plants used for flue-cured tobacco (bright or Virginia tobacco) are grown, topped, ripened, harvested and then cured. Harvesting is undertaken by removing (priming) several leaves at intervals as the leaves ripen. The leaves are generally considered ripe when the midvein turns white. The leaves are removed beginning from the bottom of the stalk, and higher leaves are primed as they ripen. Primed leaves are bundled and placed in barns for curing. With traditional flue curing practices, the farmer initially maintains the barn at a high humidity, approximately 89% relative humidity, and at a temperature of about 30 to 35° C. (85 to 95° F.) for several days to effect yellowing of the leaf. After yellowing, the color of the leaves is fixed by heating the leaves to effect drying of the leaf lamina. Drying of the lamina is accomplished by raising the temperature in the barn to about 49 to 60° C. (120 to 140° F.) for 24 to 36 hours. Heating of the barn may be effected by any means, but generally propane heat is used. Once lamina drying has occurred, the farmer heats the barn to about 72 to 77° C. (160 to 170° F.) for 1 to 3 days to dry the mid-vein or stem of the leaves.

During the above drying processes, the leaves first take on a yellow color as chlorophyll is degraded and chemical decomposition of the leaves occurs, including breaking down starch in the leaves to sugar, proteins to amino acids, and the like. As the tobacco leaves dry and turn brown, they become brittle and undergo necrosis, whereby the cuticle of the leaf cracks, exposing interior portions of the leaf tissues. After lamina and stem drying, the tobacco leaves are bulked or bundled together, and the moisture level within the leaves is raised to approximately 10 to 15% to facilitate handling of the tobacco leaves with less breakage. The tobacco leaves are then graded and sold to tobacco product manufacturers. See Colin L. Browne, *The Design of Cigarettes*, (1990) Hoechst Celanese Corporation, pp. 13–19. Flue-cured tobacco has a low nitrogen and high sugar content.

Flue-cured tobacco, such as bright or Virginia tobacco, that has undergone curing in barns directly heated with propane heat exhibits higher levels of TSNAs than does tobacco in similar barns equipped with heat exchangers. See D. M. Peele et al., "Formation of Tobacco Specific Nitrosamines in Flue-Cured Tobacco," 53rd *Tobacco Science Research Conference* (1999) Vol. 53, pp. 68–69. Without wishing to be bound by theory, it is believed that allowing combustion gases containing oxides of nitrogen from the burning propane to impinge directly upon the curing leaves provides the primary source of TSNA formation in flue-cured-tobacco. Bacterial contributions to TSNA formation in flue-cured tobacco may be relatively minor. However, TSNA levels in flue-cured tobacco are also affected by the integrity of the green leaf before curing. Leaf damage and infection of tissue (so-called "barn rot") in the green leaf may cause increased TSNA levels from bacterial invasion of the damaged tobacco leaf.

FIG. 1 is a graphical representation showing the typical effects of flue curing on tobacco leaf moisture content in terms of oven volatiles (curve A), TSNA content (curve B) including effects of heating using direct fire propane (curve C) or using heat exchangers (curve D), and temperature (curve E). As shown by curves C and D, the effect of direct fire heating with propane raises the TSNA content considerably compared to heating with heat exchangers. In FIG. 1, various stages of curing are identified with: G (green), Y (yellowing), L (lamina drying) and MV (midvein drying). At the conclusion of flue curing, the leaves preferably have a moisture content of about 10% (oven volatiles). Afterwards, the leaves are preferably reconditioned to a moisture content of about 10 to 16%.

The bactericidal gas treatment in accordance with the invention is beneficial in that TSNAs and endotoxins in the tobacco leaves can be reduced prior to the onset of conditions during flue curing favorable to bacterial growth and/or TSNA production.

Air-Cured Tobacco

In a typical air-curing process, tobacco plants are cured in an enclosure such as a barn for approximately six to ten weeks. It has been found that bacteria and/or TSNAs begin to increase significantly after about 2½ weeks under such conditions.

Air-cured tobacco, which has traditionally comprised burley or Maryland tobaccos, is grown, topped, ripened and then harvested by cutting the entire plant at the base, known as stalk-cutting. Under prior, traditional practices, the plant is harvested when leaves approximately midway up the stalk have ripened. Usually, the stalk-cut tobacco is left to wilt for several days and then is cured by being hung upside down in a barn or other suitable structure at a relative humidity of approximately 65 to 70% for 6 to 10 weeks. Heat and humidity levels are controlled by simply opening and closing ventilation ports in the barn. Generally, the yellowing process takes about 10 to 12 days, the leaves on the stalk turn from yellow to brown in another 6 to 7 days, and lamina and stem drying occur over an additional 30 to 40 days. The length of time for air-curing, and in particular for each individual step of air-curing, is highly dependent on the ambient temperature and relative humidity in the barn during air-curing. Air-cured tobacco generally has a very low sugar content and a high nitrogen content. See *The Design of Cigarettes*, at pp. 19–20. In air curing, bacterial action is believed to be the major cause of nitrosation because external sources of nitrogen oxides are not present.

Figure 2:
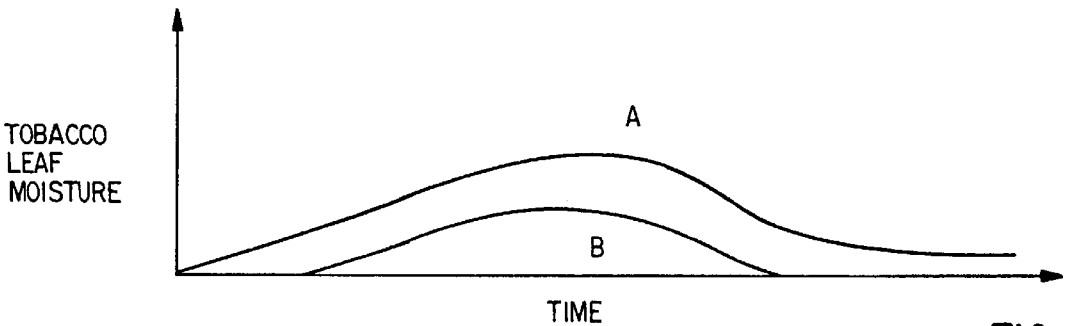
FIG. 2 Prior Art
FIG. 2 is a graphical representation of moisture content during traditional air-curing.

FIG. 2 is a graph showing the effects of air-curing on tobacco leaf moisture wherein curve A represents the moisture content of the tobacco leaf midvein and curve B represents the moisture content of the tobacco leaf lamina.

In order to accommodate the different cure rates of the treated leaves, brown leaves can be primed and dried by further air-curing at low humidity (below about 65%) and temperature or by heating, similar to what is used in flue-curing. The drying after priming preferably commences within 24 hours of priming the leaf, and is preferably completed within 3 days or less. The primed leaf may be destemmed prior to drying, if desired, so as to remove from the usable tobacco lamina the midrib and any nitrosamines that may have accumulated in the midrib.

Alternatively, air-cured tobacco leaves may be primed from the tobacco plant as they ripen (i.e., lower leaves are removed first), optionally destemmed, and cured with treatment as described herein to reduce or eliminate nitrosamine levels, bacteria, bacterial activity and/or bacterial endotoxins. Preferably, the leaves are treated with a bactericidal gas as described herein.

2. Cured Tobacco Leaves

Cured tobacco leaves are preferably treated before or during storage by contact with one or more bactericidal gases by any suitable method, as described previously herein. The cured tobacco leaves are preferably treated in an enclosed area with an effective amount of one or more bactericidal gases for a suitable period of time such that the bactericidal gas contacts all leaf surfaces. The circulation of the bactericidal gas may be aided by one or more fans or other means of circulating air as known to practitioners in the art. Alternatively, the cured tobacco can be sealed in purged containers, wherein the bactericidal gas is substituted for the container atmosphere before sealing. Preferably, the treated cured tobacco is aired by any means known to practitioners in the art before handling.

Additional Treatment Methods

The treatment of tobacco leaves, air-cured and flue-cured, with one or more bactericidal gases before, during or after curing can be combined with other known anti-bacterial treatments. Such treatments may include one or more of microwaving, as described in WO98/58555, herein incorporated by reference; lavage; radiation by ultraviolet or visible light; sonic oscillation; and any other method known to practitioners in the art, such as those described herein and in U.S. Provisional Application No. 60/166,413, filed Nov. 19, 1999, the disclosure of which is incorporated herein by reference in its entirety. The treatments may occur concurrently or separately, and in any order. Treatment of cured tobacco with liquids, such as a bactericidal gas in water or surfactant, or by lavage without subsequent drying should be avoided or minimized because increases in water content of the cured tobacco or in the storage atmosphere can promote bacterial and fungal growth.

1. Lavage

Treatment of tobacco leaves to reduce or eliminate bacteria, bacterial activity, bacterial endotoxins, fungal activity and/or tobacco-specific nitrosamines may include lavage, or washing, of the tobacco leaves with an aqueous solution. The leaves may be lavaged more than once, as needed, before completion of lamina drying or onset of necrosis in the leaves. In particular, lavage may be done on green leaves, during yellowing, at the conclusion of yellowing and, optionally, during lamina drying. Lavage may also be performed on cured tobacco, but subsequent drying is recommended.

Suitable aqueous solutions may include disinfectants such as, but not limited to, bicarbonate salts, such as sodium bicarbonate, ammonium bicarbonate or potassium bicarbonate; carbonate salts such as sodium carbonate, ammonium carbonate or potassium carbonate; chlorine-containing compounds, such as chlorine dioxide, sodium hypochlorite and sodium chlorite; peroxides; low molecular weight alcohols, such as methanol, ethanol and propanol; quaternary ammonium compounds such as benzalkonium chloride, octyl decyl dimethyl ammonium chloride, decyl dimethyl ammonium chloride, dioctyl dimethyl ammonium chloride and alkyl dimethyl benzyl ammonium chloride; and derivatives thereof. Other disinfectant materials suitable for use will be apparent to practitioners in the art. The disinfectant solution may be used in any effective amount.

The disinfectant may be dissolved or dispersed in any suitable aqueous or non-aqueous solvent, including but not limited to water and polar organic solvents such as low molecular weight alcohols, including methanol, ethanol and propanol. Other suitable solvents will be apparent to practitioners in the art.

Particularly preferred solutions include disinfectant solutions of bicarbonate salts, preferably sodium bicarbonate, carbonate salts, preferably sodium carbonate, and solutions of chlorine-containing compounds, preferably chlorine dioxide, dissolved in water. When the disinfectant is a low molecular weight alcohol, a preferred solution is 70% ethanol in water.

The disinfectant solution used to treat air-cured or flue-cured tobacco is most preferably a saturated solution, though any effective amount of disinfectant can be used. The solution may be used at any desired temperature, for example, ambient temperature. Depending on the particular disinfectant chosen, the temperature of the solution may be raised or lowered to increase solubility of the disinfectant. However, for ease of preparation and use, it is most desirable to use a disinfectant having good solubility at ambient temperature.

Alternately, water may be used as a wash solution. The water may be at any temperature, but is preferably heated to a temperature of from about 25° C. to about 55° C. in order to kill or disrupt the biological activity of the bacteria. The length of lavage needed at any particular temperature to effectively reduce bacterial and fungal populations or their activity will be apparent to practitioners in the art based on factors such as the type and amount of bacteria and/or fungal growth present, the integrity of the tobacco leaves, and the like.

The solution, whether disinfectant, heated disinfectant or heated water, is applied to the tobacco leaves by any means possible, particularly by rinsing or spraying or dipping the leaves in the solution. Whether the tobacco leaves are sprayed or dipped, agitation of the tobacco leaves is helpful to evenly distribute the solution, and to aid in removing the bacterial and fungal populations by effectively shaking the bacteria and fungal growth off the tobacco leaves. Agitation of the leaves in multiple directions is preferable, for example, front to back, side to side and up and down. If the leaves are lavaged (washed) by spraying, it is preferred that the leaves be entirely soaked so that the solution is running freely from all leaf surfaces. Preferably, the tobacco leaves are dipped in the solution and agitated for a period of time. More preferably, the leaves are completely submerged for a period of at least 10 minutes, most preferably at least 15 to 20 minutes, with gentle agitation of the tobacco leaves throughout the entire period of submersion.

During lavage, some or all of the bacteria and fungi on the leaf surfaces are washed off the leaf surface. The bacteria may also be killed or harmed in the wash solution by other chemical or mechanical interactions effected by the lavage.

After lavage with a disinfectant wash solution such as by spraying or immersion, the treated leaves may optionally be rinsed with plain water in order to remove the disinfectant solution.

2. Radiation

The tobacco leaf may be treated with radiation, in particular visible or ultraviolet (UV) light. High intensity light in the visible and ultraviolet ranges is believed to have a controlling effect on bacteria and/or fungi. Therefore, treatment of tobacco before or during curing, or before or during storage, with an effective amount of visible or ultraviolet light, preferably of high intensity, will reduce or eliminate bacterial populations and/or activity and fungal growth on the tobacco, consequently lowering bacterial populations and activity, fungal growth, and TSNA and bacterial endotoxin levels in the cured tobacco. Practitioners in the art will be able to adjust the wavelength, intensity and time of treatment as desired to treat the tobacco leaves at different times before or during curing and before or during storage. The tobacco leaves may be treated as green leaves, during yellowing, after yellowing and possibly early during lamina drying as well as before or during storage. In air-cured tobacco, where the temperature is not raised during curing, treatment with ultraviolet or visible light can be conducted after yellowing, and/or up until completion of stem drying, consistent with conditions that bring about reduction of tobacco-specific nitrosamines. As with treatment with aqueous solutions, light treatment of the tobacco leaves may occur multiple times before and during curing.

3. Sonic Oscillation

Sonic oscillation may also be used for removal of surface bacteria and fungal growth from tobacco leaves. Sonic oscillation aids in the removal of bacteria and fungal growth by agitation of the leaf, such as by ultrasound. Sonic oscillation may be applied to the leaves in conjunction with the use of any other treatment known to practitioners in the art to remove bacteria and fungal growth present on tobacco leaf and plant surfaces. Sonic oscillation may be applied directly to the leaf or through a liquid medium, such as an aqueous solution.

EXAMPLES

Treatment of the tobacco leaves during curing with a bactericidal gas and, optionally, an aqueous solution, visible or ultraviolet light, sonic oscillation, or a combination thereof as described herein, reduces or eliminates nitrite producing bacteria or bacterial activity and fungal growth on the leaf surfaces and therefore aids in the reduction or elimination of TSNAs and bacterial endotoxins formed during curing of tobacco, and eliminates bacterial and fungal contamination of cured tobacco. Specific bactericidal gasses and methods of applying the same are set forth in the examples below. The examples are meant to be illustrative only. Equivalent methods and materials will be apparent to those skilled in the art and are intended to be encompassed herein.

Example 1

Flue-cured bright tobacco is harvested, placed on racks and loaded into a barn. The barn is sealed and the tobacco leaves are treated with an effective amount of chlorine dioxide gas introduced at the top of the barn. The gas is allowed to filter down through the leaves until all leaves have been treated. The treated leaves have little or no bacterial or fungal activity after treatment. Normal curing is allowed to proceed. The resultant cured tobacco has a lowered level of tobacco specific nitrosamines and bacterial endotoxins compared to untreated cured tobacco.

Example 2

Burley tobacco is harvested and hung in a barn to cure. After 5 days, the barn is sealed and the tobacco leaves are treated with an effective amount of sulfur dioxide introduced at the top of the barn. The gas is allowed to filter down through the leaves until all leaves have been treated. After treatment, the barn is ventilated. The treated leaves have little or no bacterial or fungal activity after treatment or ventilation. Normal curing is resumed. The resultant cured tobacco has a lowered level of tobacco specific nitrosamines and bacterial endotoxins compared to untreated cured tobacco.

Example 3

Flue-cured bright tobacco is harvested, placed on racks and loaded into a barn. After 12 hours of drying, the barn is sealed and the tobacco leaves are treated with an effective amount of ethylene oxide gas introduced at the top of the barn. The gas is allowed to circulate through the leaves aided by circulating fans until all leaves have been treated. The barn is ventilated immediately after conclusion of the gas treatment. The gassed tobacco leaves are treated by ultraviolet radiation before normal curing is resumed. The treated leaves have little or no bacterial or fungal activity. The resultant cured tobacco has a lowered level of tobacco specific nitrosamines and bacterial endotoxins compared to untreated cured tobacco.

Examples 4–7

The above examples are repeated, except that the tobacco leaves are removed in batches to a vessel for treatment with the specified bactericidal gas. The gas is allowed to filter through the leaves with or without the additional aid of a circulating fan. Those leaves treated with ultraviolet radiation are treated after the gas has been purged in the vessel and before they are returned to the barn to resume curing. The treated leaves have little or no bactericidal or fungal activity. The resultant cured tobacco has a lowered level of tobacco specific nitrosamines and bacterial endotoxins compared to untreated cured tobacco.

Example 8

Figure 3:
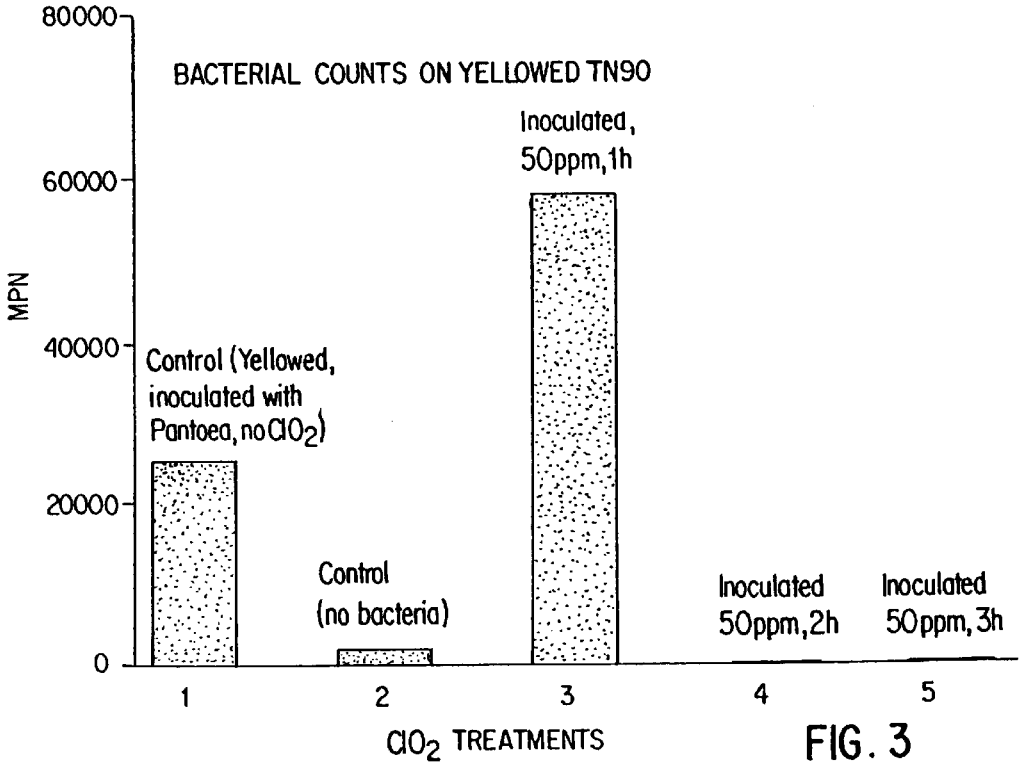
FIG. 3 is a graphical representation of the mean population number of Pantoea bacteria on burley tobacco with and without treatment by $ClO_2$ gas.

Greenhouse grown burley tobacco (TN90) was harvested. The TN90 leaves were divided into five batches and treated as follows:

1. inoculated control—inoculated with Pantoea bacteria and yellowed
2. control—harvested without further treatment or curing
3. inoculated with Pantoea bacteria and treated for one hour with 50 ppm $ClO_2$ gas during yellowing
4. inoculated with Pantoea bacteria and treated for two hours with 50 ppm $ClO_2$ gas during yellowing
5. inoculated with Pantoea bacteria and treated for three hours with 50 ppm $ClO_2$ gas during yellowing The most probable population number (MPN) of bacteria was determined for each batch. The results as shown in FIG. 3 clearly demonstrate the beneficial effect over time of treatment with $ClO_2$ gas in killing the bacterial population. While not wishing to be bound by theory, the inventors herein believe the initial increase in bacterial population concurrent with initial $ClO_2$ treatment is due to bacterial reproduction occurring before the effects of $ClO_2$ are apparent. It is evident that between one and two hours of initiating $ClO_2$ treatment all bacteria have died.

Example 9

Figure 4:
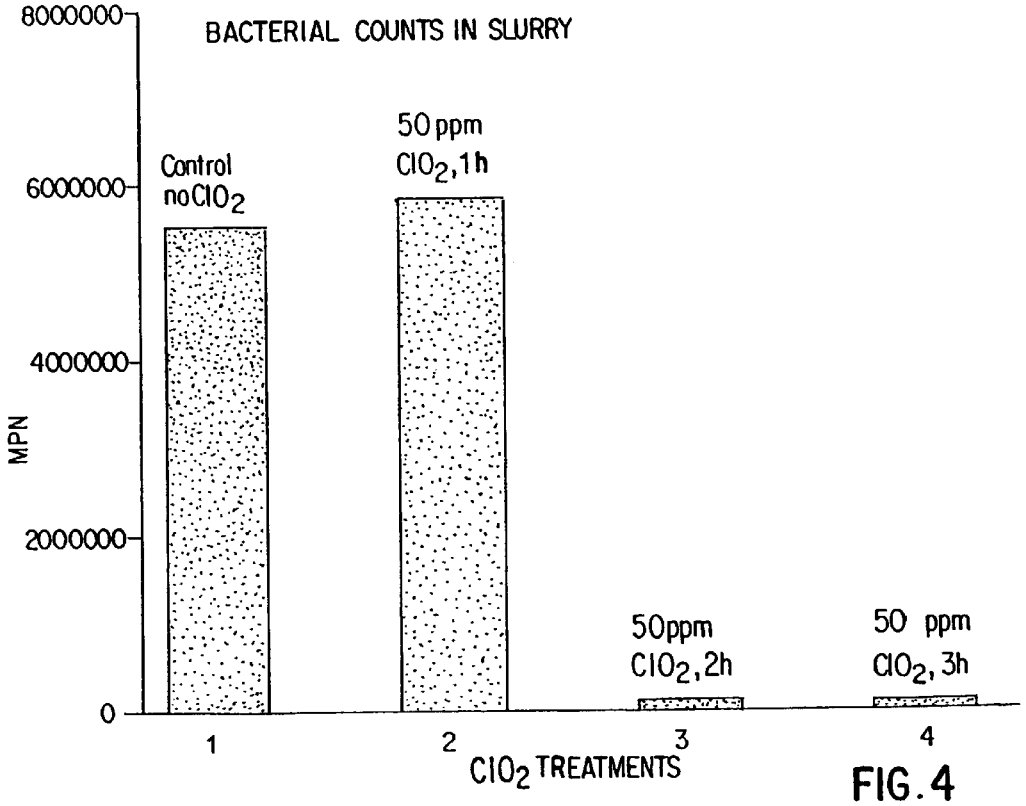
FIG. 4 is a graphical representation of the mean population number of Pantoea bacteria in an aqueous tobacco slurry in petri dishes with and without treatment by $ClO_2$ gas.

An aqueous slurry of Pantoea bacteria in tobacco was placed in petri dishes and treated as follows:

1. control—no $ClO_2$ added
2. inoculated with Pantoea bacteria and treated one hour with 50 ppm $ClO_2$ gas
3. inoculated with Pantoea bacteria and treated two hours with 50 ppm $ClO_2$ gas
4. inoculated with Pantoea bacteria and treated three hours with 50 ppm $ClO_2$ gas The MPN of each dish was measured and is shown in FIG. 4. Treatment with $ClO_2$ over time shows complete killing of the bacterial population. While not wishing to be bound by theory, the inventors herein believe the initial increase in bacterial population concurrent with initial $ClO_2$ treatment is due to bacterial reproduction occurring before the effects of $ClO_2$ are apparent. It is evident that between one and two hours of initiating $ClO_2$ treatment all bacteria have died.

Example 10

Flue cured tobacco is treated with chlorine dioxide for 1 hour before storage. The bacterial and fungal growth in the stored cured tobacco is lower than that of untreated stored cured tobacco.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

What is claimed is:

1. A method of reducing or eliminating one or more of bacteria, bacterial activity and fungal activity from a cured tobacco leaf comprising treating the cured tobacco leaf with an effective amount of one or more bactericidal gases to reduce or eliminate one or more of the bacteria, bacterial activity and fungal activity from the cured tobacco leaf by contacting the tobacco leaf with one or more bactericidal gases.

2. The method of claim 1, further comprising treating the cured tobacco leaf with an effective amount of one or more of an aqueous solution, sonic oscillation, visible or ultraviolet light, or a combination thereof.

3. The method of claim 1, wherein one or more bactericidal gases are selected from a chlorine gas, ethylene oxide, ozone, propylene oxide or a mixture thereof.

4. The method of claim 3, wherein the chlorine gas is chlorine dioxide.

* * * * *